US005123809A

United States Patent [19]

Ito

[11] Patent Number: 5,123,809

[45] Date of Patent: Jun. 23, 1992

[54] VEHICLE FUEL PUMP

[75] Inventor: Motoya Ito, Anjo, Japan

[73] Assignee: Nippondenso Co., Ltd., Kariya, Japan

[21] Appl. No.: 654,974

[22] Filed: Feb. 14, 1991

[30] Foreign Application Priority Data

Feb. 16, 1990 [JP] Japan ..... 2-36922
Jan. 24, 1991 [JP] Japan ..... 3-6851

[51] Int. Cl.[5] ..... F04D 5/00
[52] U.S. Cl. ..... 415/55.1
[58] Field of Search ..... 415/55.1, 55.2, 55.3, 415/55.4, 55.5, 55.6, 169.1

[56] References Cited

U.S. PATENT DOCUMENTS

| | | | |
|---|---|---|---|
| 1,689,579 | 10/1928 | Burks | 415/55.7 |
| 2,042,499 | 6/1936 | Brady | 415/55.1 |
| 3,899,266 | 8/1975 | Masai et al. | 415/55.1 |
| 4,204,802 | 5/1980 | Schonwald et al. | 415/55.1 |

FOREIGN PATENT DOCUMENTS

| | | | |
|---|---|---|---|
| 32095 | 4/1981 | Japan | 415/55.1 |
| 18495 | 1/1982 | Japan | 415/55.1 |
| 60-173389 | 9/1985 | Japan . | |
| 198396 | 10/1985 | Japan | 415/55.1 |

OTHER PUBLICATIONS

Effect of machining a reverse side of an impeller of a circumferential flow pump Apr. 1959.

*Primary Examiner*—John T. Kwon
*Attorney, Agent, or Firm*—Cushman, Darby & Cushman

[57] ABSTRACT

A vehicle fuel pump having an impeller on which close fins are formed continuously in the circumferential direction, and a motor supplied with a voltage from a vehicle power source to drive and rotate the impeller. A fuel in a pump chamber formed between the opposed surfaces of each adjacent a pair of close fins of the impeller is pressurized and forced out by the rotation of the impeller. The delivery pressure of the fuel pumped out of the fuel pump is set to a level higher than the pressure in an intake pipe communicating with the engine by about 2 to 3 kg/cm$^2$, while the flow rate during engine operation is set to a range of 50 to 200 l/h. At least part of the side surface of one of each pair of close fins located on the downstream side with respect to the direction of rotation of the impeller is formed parallel to a plane perpendicular to the direction of rotation of the impeller, while an outer end portion of the side surface of the other close fin located on the upstream side is formed so as to be slanted relative to a plane perpendicular to the direction of impeller rotation so that the capacity of the pump chamber is increased, whereby the lowest flow rate in a state where the voltage supplied from the vehicle power source drops when the engine is started is set to 20 l/h or higher, thereby preventing engine starting failure.

16 Claims, 4 Drawing Sheets

VEHICLE FUEL PUMP

BACKGROUND OF THE INVENTION

This invention relates to a regeneration type fuel pump for use in a vehicle such as a motor vehicle and, more particularly, to a fuel pump for supplying fuel to an injector at a high pressure.

In a conventional fuel pump, such as the one disclosed in Japanese Patent Unexamined Publication No. 60-173389, an impeller is accommodated in a pump housing and is fixed to an armature. As shown in FIG. 12, the impeller 10 has a plurality of grooves 11 formed in its outer circumferential portion. As the impeller 10 rotates, fuel is pumped out and supplied to an external injector by being moved from each groove 11 to the adjacent groove 11 in one direction while being pressurized.

In fuel pumps ordinarily used for vehicles, an air intake pipe pressure is introduced as a back pressure of a pressure regulating valve to constantly maintain the fuel pressure at a level higher than the intake pipe pressure by a set pressure (2.55 kg/cm$^2$), thereby definitely determining the injection rate with the injector energization time.

Such fuel pumps are driven by a battery mounted on the vehicle at a voltage ranging from 12 to 14 V, and the flow rate of the fuel pump is set within a range (50 to 200 l/h) predetermined correspondingly.

However, it has been found that at the time of starting, in particular, a cold start, the voltage of the vehicle battery is so low, about 8.5 V, that the flow rate is considerably reduced and that, in the worst case, the flow rate is lower than 20 l/h which is the lowest flow rate necessary for starting the engine. This lowest necessary flow rate is required to expel fuel vapor accumulated in the fuel piping during stoppage. If the flow rate is not maintained at or above this level, the engine cannot be suitably started.

To cope with this problem, according to the above-mentioned prior art, the number of revolutions of the impeller may be increased in order to increase the delivery flow rate. To increase the number of impeller revolutions, however, it is necessary to increase the motor driving voltage. The motor load is thereby considerably increased.

SUMMARY OF THE INVENTION

In view of these problems, it is ar object of the present invention to increase the delivery flow rate without increasing the number of motor revolutions, to maintain the delivery flow rate necessary for starting the engine even at the time of starting when the vehicle battery voltage is low, and to thereby prevent engine starting failure.

To achieve this object, according to the present invention, there is provided a vehicle fuel pump wherein the delivery pressure of the fuel pumped out of the fuel pump is set to a level higher than the pressure in an intake pipe communicating with the engine by about 2 to 3 kg/cm$^2$, while the flow rate during engine operation is set to a range of 50 to 200 l/h; wherein at least part of the side surface of one of each pair of close fins located on the downstream side with respect to the direction of rotation of the impeller is formed parallel to a plane perpendicular to the direction of rotation of the impeller, while an outer end portion of the side surface of the other close fin located on the upstream side is formed so as to be slanted relative to a plane perpendicular to the direction of rotation of the impeller so that the capacity of the pump chamber is increased; and wherein the lowest flow rate in a state where the voltage supplied from the vehicle power source drops when the engine is started is set to 20 l/h or higher.

DESCRIPTION OF THE PREFERRED EMBODIMENTS

An embodiment of the present invention will be described below with reference to FIGS. 1 to 4.

Figure 1:
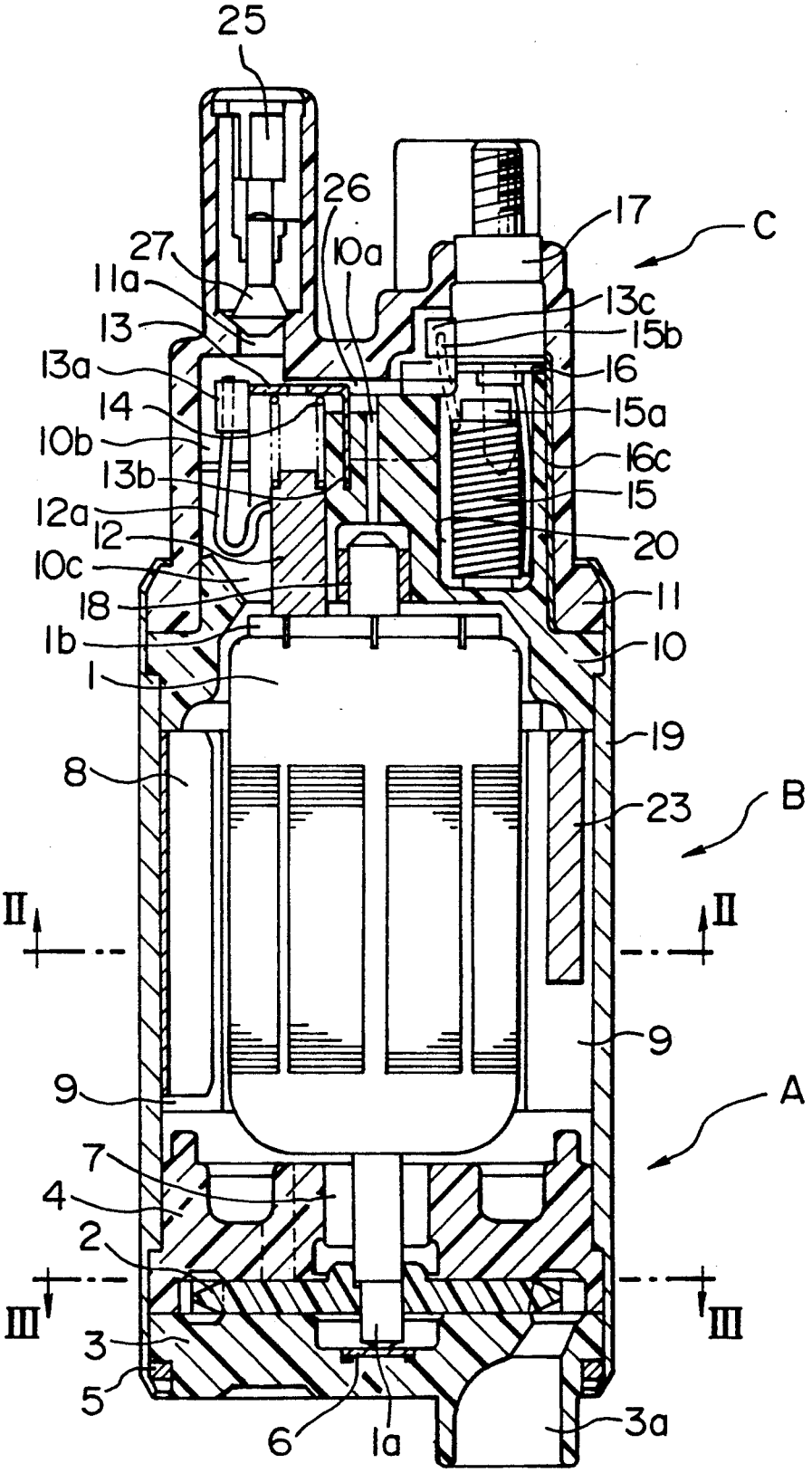
FIG. 1 is a longitudinal cross-sectional view of a fuel pump in accordance with the present invention.

As shown in FIG. 1, the fuel pump in accordance with the embodiment has a pump section A provided in a lower end portion of a cylindrical fuel pump housing 19, a motor section B provided in an intermediate portion, and a delivery section C provided in an upper end portion.

The pump section A has a pump chamber which is formed between a pump cover 3 and a pump casing 4 and in which an reproduction pump type impeller 2 is accommodated. A fuel inlet 3*a* is formed in the pump cover 3. In the pump casing 4, a rotating shaft 1*a* of an armature 1 is rotatably supported by a bearing 7. The impeller 2 is fitted around the rotating shaft 1*a* so as to be slidable in the axial direction.

Figure 3:
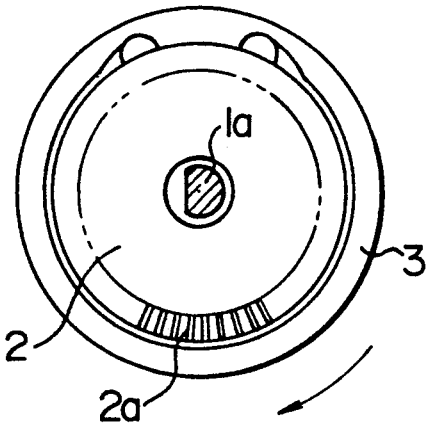
FIG. 3 is a cross-sectional view taken along the line III—III of FIG. 1.
Figure 4:
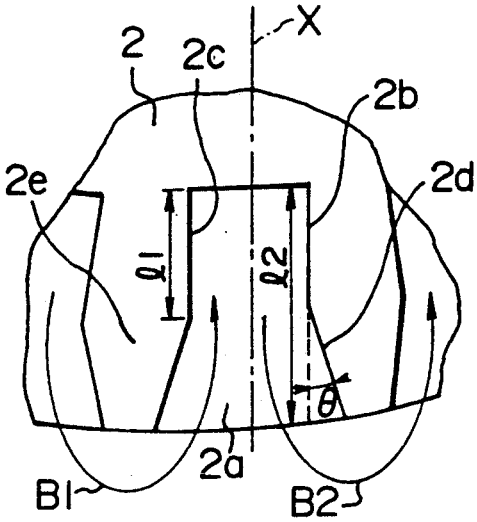
FIG. 4 is an enlarged plan view of an essential portion of the impeller in accordance with a first embodiment of the present invention.
Figure 5:
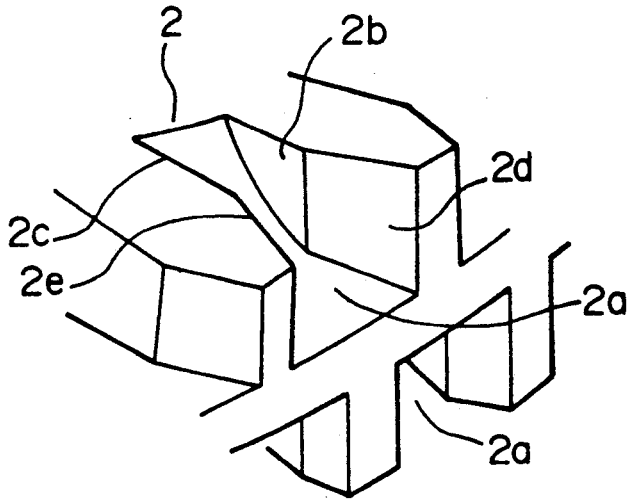
FIG. 5 is an enlarged perspective view of the essential portion of the impeller shown in FIG. 4.

Next, the shape of the impeller 2 will be described with reference to FIGS. 3 to 5.

On each of two sides of the impeller 2, close fins opened on the corresponding side alone are formed, and a plurality of grooves 2*a* are defined between these close fins. As shown in FIG. 4, each of grooves 2*a* is formed by a pair of straight portions 2*b* and 2*c* parallel to a center line X of the impeller 2, and slanted portions 2*d* and 2*e*. The distance between the slanted portions 2*d* and 2*e* is increased from the straight portions 2*b* and 2*c* to the outer circumferential side of the impeller 2. As shown in FIG. 5, the depth of the groove portion 2*a* is gradually increased toward the outer circumferential side. The length $l_1$ of the straight portions 2*b* and 2*c* is determined with respect to the length $l_2$ of a straight line extending from the inner end of the straight portion 2b or 2c to the outer circumference so that the ratio $l_1/l_2$ is 0.6. The angle $\theta$ between the slanted portions 2d and 2e and the productions of the straight line portions 2b and 2c is set to 18°.

An annular elastic member 5 is provided between the pump cover 3 and the fuel pump housing 19. The housing 19 is caulked to fix the cover 3 and the casing 4 in the casing 19. A lower surface of the rotating shaft 1a is received by a thrust bearing 6 provided on the cover 3.

Figure 2:
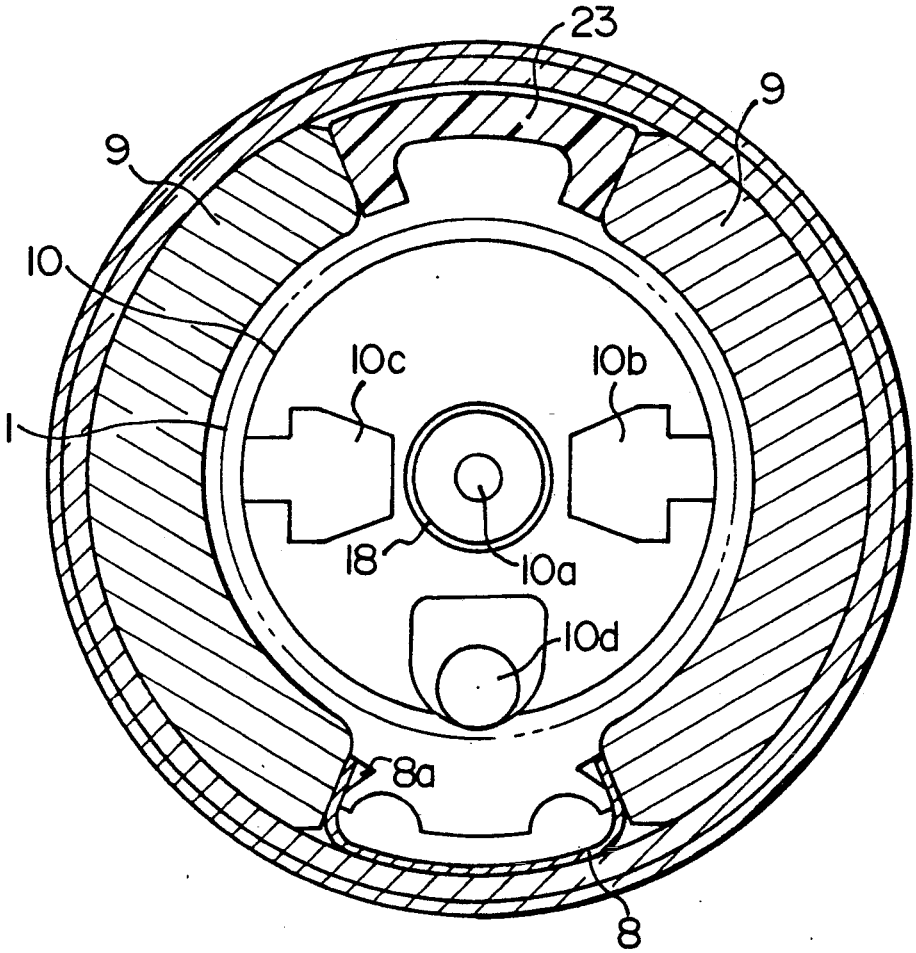
FIG. 2 is a cross-sectional view taken along the line II—II of FIG. 1, showing a state in which the armature is removed.

The motor section B is mainly composed of the armature 1 and field magnets 9 accommodated in the housing 19. As shown in FIG. 2, a stopper 23 formed of a non-magnetic material and a spring piece 8 having guides 8a formed by bending at its upper end and two side portions bent so as to be generally C-shaped are inserted between the two field magnets 9 having a circular-arc shape, thereby positioning the two magnets 9. Fuel passages are formed between the spring piece 8, the stopper 23 and the armature 1. As shown in FIG. 1, a brush 12 inserted into a vertical hole 10c of a bearing holder member 10 is brought into contact with a planar commutator 1b formed at an end surface of the armature 1.

As shown in FIG. 1, the housing portion of the delivery section C is divided into two pieces: the bearing holder member 10 and a cover member 11, a gap 26 is formed between the bearing holder member 10 and the cover member 11 having a delivery port 25. The gap 26 and the periphery of a bearing 10 retained by the bearing holder member 10 communicate with each other through a residence prevention hole 10a. A pigtail 12a of the brush 12 is led out in a direction perpendicular to the longitudinal direction of the brush 12. The vertical hole 10c is formed into a partially opened shape such that the pigtail 12a is vertically movable. The vertical hole 10c communicates with a cooling passage 10b which provides a communication between the interior of the pump and the gap 26 between the bearing holder member 10 and the cover member 11.

An arm portion 13b of an L-shaped brush pressing plate 13 extending downward as viewed in FIG. 1 in section is embedded and fixed in an upper portion of the bearing holder member 10. The brush pressing plate 13 presses the brush 12 against the planar commutator 1b through a brush spring 14 to make the brush 12 contact with the commutator 1b. The end of the pigtail 12a led from the brush 12 is connected to a generally U-shaped pinching portion 13a in a side portion of the brush pressing plate 13 by being pressed therein.

A delivery hole 11a is formed in the cover member 11. A check valve 27 having a mushroom-like shape is provided at the delivery hole 11a. The check valve 27 is of a type such as to close the delivery hole 11a by the pressure in a piping connected to the delivery port 25.

The materials of the bearing holder member 10 and the cover member 11 are, preferably, polybutylene terephthalate, polyacetal or the like reinforced with glass fiber. The materials of the pump cover 3, the impeller 2 and the pump casing 4 are, preferably, a phenolic resin, PPS (polyphenylene sulfide) or the like reinforced with glass fiber. The material of the housing 19 of the fuel pump is iron.

As shown in FIG. 1, a choke coil 15 having a cylindrical core 15a is inserted into a vertical hole 20 having a longitudinal axis parallel to that of the armature 1.

One end 15b of the choke coil 15 is connected to a generally U-shaped pinching portion 13 of the brush pressing plate 13 by being pressed therein. The pinching portion 13c is formed at an extreme end of a generally L-shaped arm portion laterally extending from the brush pressing plate 13. The other end 15c of the choke coil 15 is connected to a pinching portion 16b of a metallic plate 16 by being pressed therein. A terminal hole is formed in the metallic plate 16, and a terminal rid 17 is press-fitted in the terminal hole of the metallic plate 16, as shown in FIG. 1. A bent portion 16c extending downward from a side portion of the metallic plate 16 is pinched between the bearing holder member 10 and the cover member 11.

As shown in FIG. 2, a delivery hole 10d is formed in the bearing holder member 10, and the delivery hole 10d is opened to the gap 26 between the bearing holder member 10 and the cover member 11.

An electrical connection is established between the terminal rod 17, the metallic plate 16, the choke coil 15, and the brush 12, and electric power is supplied to the armature through the planar commutator 1b. The driving voltage of the vehicle battery (not shown) is supplied to the terminal rod 17. This driving voltage varies in a range of 12 to 14 V according to the load. With respect to the number of revolutions of the driven armature 1, based on the supplied voltage, the fuel flow rate characteristics of the impeller 2 are set so that a predetermined flow rate at a predetermined delivery pressure is obtained. Noise components generated by contact rectification with the brush 12 and the planar commutator 1b are suppressed by the winding and the core 15a of the choke coil 15 before the current flows tc the external conductor connected to the terminal rod 17.

The operation of the thus-constructed pump will be described below. When a voltage is supplied from the vehicle power source to the terminal rod 17 so that a current flows through the brush 12, the armature 1 rotates according to the current, the torque of the armature 1 is transmitted from the rotating shaft 1a to the impeller 2, the impeller 2 thereby rotates clockwise as indicated by the arrow in FIG. 3. The fuel thereby introduced is successively supplied to the plurality of fin grooves 2a of the impeller 2, as indicated by the arrows B1 and B2 in FIG. 4 and is thereby pressurized and discharged into the space in the housing 19. The discharge fuel is supplied to an injector (not shown) via the annular space between the armature 1 and the field magnets 9, the cooling passage 10b, the delivery hole 11a and the delivery port 25. The delivery pressure of the fuel supplied to the injector is controlled with a pressure regulating valve having a back pressure to which the pressure of an intake pipe is introduced. The fuel pressure is thereby maintained constantly at a level higher than the intake pipe pressure by a predetermined pressure (2.55 kg/cm$^2$), thereby definitely determining the injection rate with respect to the injector energization time. Since the intake pipe pressure varies depending upon the state of engine operation, the characteristics of the pump are set so that the flow rate ranges from 50 to 200 l/h while the delivery pressure changes within a range of 2.55 to 3.6 kg/cm$^2$.

Figure 6:
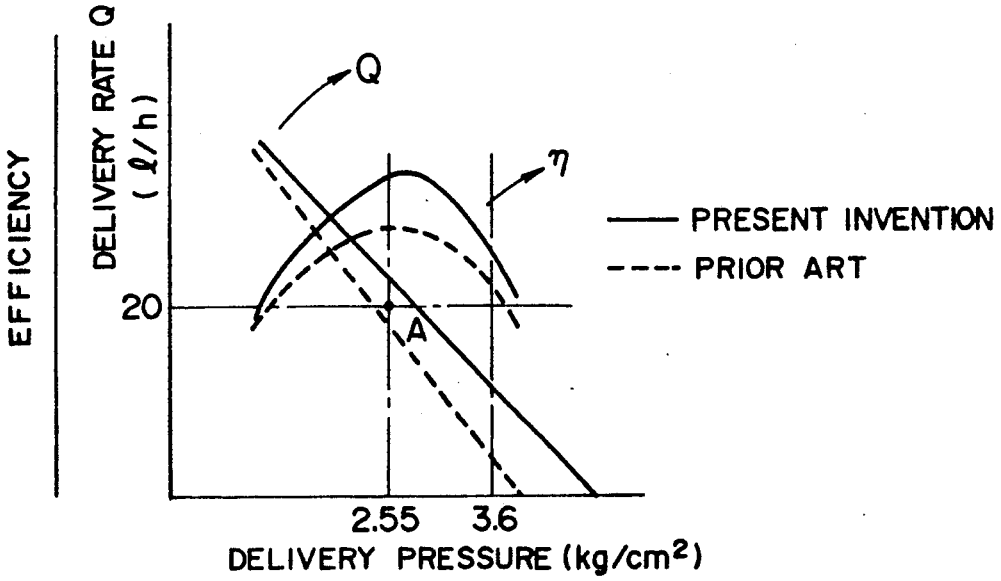
FIG. 6 is a characteristic diagram of the relationships between the delivery pressure, the efficiency and the delivery flow rate of the pump of the present invention and the conventional pump.
Figure 12:
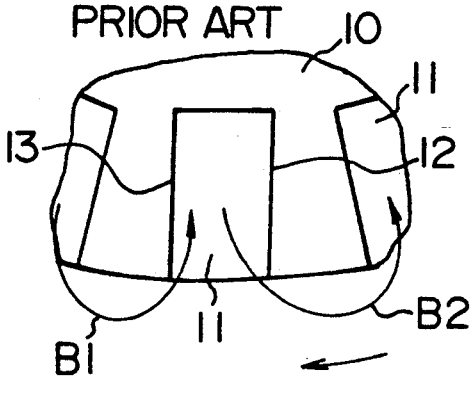
FIG. 12 PRIOR ART
FIG. 12 is a plan view of an essential portion of the conventionl impeller.

In this arrangement, at the time of starting, in particular, a cold start, the voltage of the vehicle battery drops to about 8.5 V at the worst, at which the number of revolutions of the impeller is so small that, in the case of the arrangement shown in FIG. 12, a flow rate of 20 l/h (a delivery pressure of 2.55 kg/cm$^2$) necessary for starting cannot be maintained (as at the point A of FIG. 6)

and so that fuel vapor in the fuel piping cannot be suitably expelled, resulting in starting failure.

In this embodiment, the grooves 2a of the impeller 2 are defined by the straight portions 2b and 2c and the slanted portions 2e and 3f. When the fuel flows out of each groove 2a as indicated by the arrow B1, the fuel can suitably enter the next groove 2a because the groove size is increased at the outer circumferential side in comparison with the conventional arrangement. The flow resistance is thereby reduced and the rate at which the fuel is discharged while being pressurized be the impeller 2 can thereby by increased.

Consequently, in this embodiment, as indicated by the solid lines in FIG. 6 in comparison with the arrangement of FIG. 12 indicated by the broken lines, the delivery flow rate and the efficiency can be improved by 20% with respect to the maximum efficiency. The minimum necessary flow rate can therefore be maintained even if the driving voltage of the vehicle power source is reduced to 8.5 V. That is, the starting performance can be improved.

Figure 7:
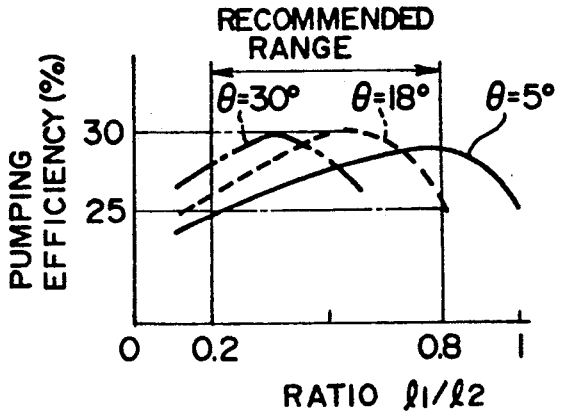
FIG. 7 is a characteristic diagram of the pumping efficiency with respect to the ratio $l_1/l_2$.
Figure 8:
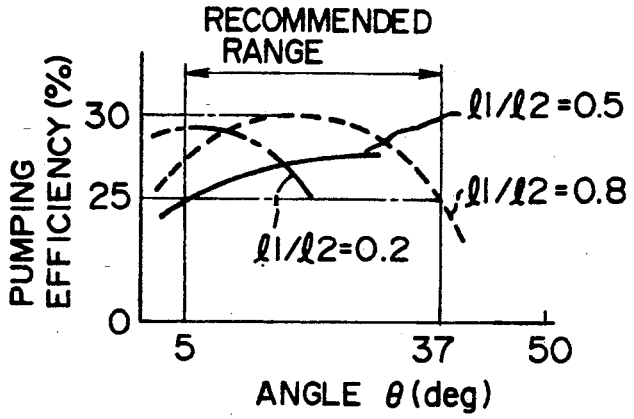
FIG. 8 is a characteristic diagram of the pumping efficiency with respect to the angle $\theta$.

The optimum setting of the ratio $l_1/l_2$ and the angle $\theta$ is as described below. As is apparent from the experimental data shown in FIGS. 7 and 8, it was found that, to maintain the pumping efficiency at 25% or higher, it is preferable to set the ratio $l_1/l_2$ to a range of 0.2 to 0.8 and the angle $\theta$ to a range of 5° to 37°.

Figure 9:
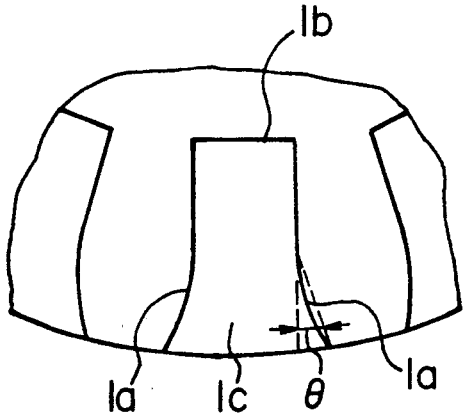
FIGS. 9 to 11 are enlarged plan views of essential portions of second to fourth embodiment of the present invention.

In a second embodiment shown in FIG. 9, the slanted portions 2d and 2e, which are straight in the first embodiment, are curved. In this case, the angle $\theta$ is defined to represent the angle between the production of the straight portion 2b or 2c and an imaginary line which connects the point of inflection of the straight portion 2b or 2c and the slanted portion 2d or 2e and the outer circumferential end of the slanted portion 2d or 2e.

Figure 10:
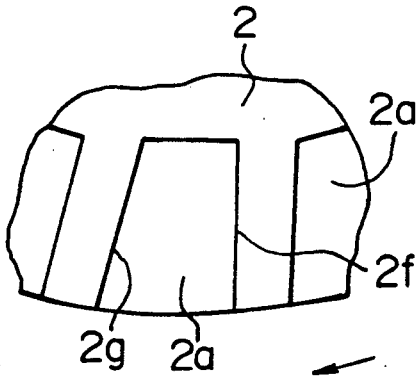
Figure 11:
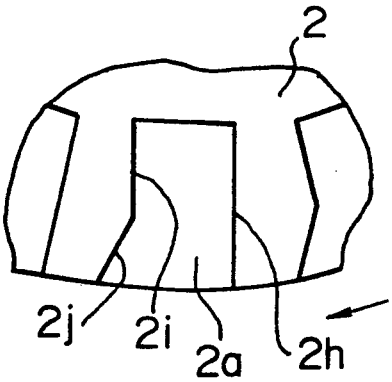

In each of third and fourth embodiments shown in FIGS. 10 and 11, respectively, the portion defining each groove on the reverse rotation side relative to the direction of rotation of the impeller 2 indicated by the arrow is formed as a straight portion 2f or 2h parallel to the center line. The portion on the normal rotation side may be formed as a slanted portion extended toward the outer circumferential side or a combination of a straight portion 2i and a slanted portion 2j as in the case of the first embodiment.

That is, the straight portion 2f or 2h is provided on the rotation side to enable a greater part of the amount of fuel introduced into each groove 2a to be forced to the outer circumferential side along the straight portion 2f or 2h and to be supplied to the next groove 2a.

What is claimed is:

1. A vehicle fuel pump comprising:

a casing;

an impeller on which close fins are formed continuously in a circumferential direction thereof; and driving means supplied with a voltage from a power source mounted on the vehicle to drive and rotate said impeller, a fuel in a pump chamber formed between opposed surfaces of each adjacent pair of close fins of said impeller being pressurized and pumped by rotation of said impeller;

wherein the delivery pressure of the fuel pumped out of the fuel chamber is set to a level higher than the pressure in an intake pipe communicating with the engine by about 2 to 3 kg/cm$^2$, while the flow rate during engine operation is set to a range of 50 to 200 l/h;

wherein at least a pressure feed surface part of a side surface of one of each pair of said close fins located on a downstream side with respect to the direction of rotation of said impeller is parallel to a plane perpendicular to a direction of rotation of said impeller, while an outer end portion of the side surface of the other close fin located on the upstream side is formed so as to be slanted relative to said plane perpendicular to the direction of rotation of said impeller;

wherein a slanted surface symmetric with the outer end portion of the other close fin on the upstream side is formed in an outer end portion of the side surface of the close fin on the downstream side;

wherein a force-feed surface parallel to a plane perpendicular to the direction of rotation of said impeller is formed in the side surface of the close fin on the downstream side so as to extend from the root end of the close fin through a predetermined length in the radial direction so that a lowest flow rate in a state where the voltage supplied from the vehicle power source drops when the engine is started is 20 l/h or higher.

2. A vehicle fuel pump according to claim 1, wherein a radial length $l_1$ of said pressure-feed surface is 20 to 80% of an overall radial length $l_2$ of the close fin.

3. A vehicle fuel pump according to claim 2, wherein a angle of inclination of the outer end portion of the side surface of the other close fin on the upstream side is 5° to 37°.

4. A vehicle fuel pump according to claim 1, wherein the slanted surface formed in the outer end portion of the side surface of the other close fin on the upstream side is curved.

5. A vehicle fuel pump according to claim 1, wherein said impeller has close fins formed on its two sides.

6. A vehicle fuel pump according to claim 1, wherein a surface parallel to the force-feed surface formed in the side surface of the close fin on the downstream side is formed in the side surface of the other close fin on the upstream side so as to extend from the root end of the close fin through a predetermined length in the radial direction.

7. A vehicle fuel pump comprising:

a casing;

an impeller on which close fins are formed continuously in a circumferential direction thereof; and driving means supplied with a voltage from a power source mounted on the vehicle to drive and rotate said impeller, a fuel in a pump chamber formed between opposed surfaces of each adjacent pair of close fins of said impeller being pressurized and pumped by rotation of said impeller;

wherein a delivery pressure of the fuel pumped out of the fuel pump is set to a level higher than the pressure in an intake pipe communicating with the engine by about 2 to 3 kg/cm$^2$, while the flow rate during engine operation is set to a range of 50 to 200 l/h;

wherein at least part of a side surface of one of each pair of close fins located on a downstream side with respect to a direction of rotation of said impeller is formed parallel to a plane perpendicular to a direction of rotation of said impeller;

wherein said pump chamber is formed into a shape restricted ion a central side and extended on an outer circumferential side so that fuel flows by whirling out of the fin groove formed between each adjacent pair of fins and is introduced into an adjacent pump chamber on the downstream side;

wherein said impeller has close fins symmetrically and separately formed on its two sides so that the lowest flow rate in a state where the voltage supplied from the vehicle power source drops when the engine is started is 20 l/h or higher; and wherein a slanted portion is formed on an outer end portion of a downstream side of said close fin so as to be symmetrically formed with said slanted portion located on the upstream side of said close fin.

8. A vehicle fuel pump according to claim 7, wherein a force-feed surface parallel to a plane perpendicular to the direction of rotation of said impeller is formed in the side surface of the close fin on the downstream side so as to extend from the root end of the close fin through a predetermined length in the radial direction.

9. A vehicle fuel pump according to claim 7, wherein pressure-feed surfaces parallel to a plane perpendicular to the direction of rotation of said impeller are respectively formed in the side surfaces of each pair of close fins defining the pump chamber so as to extend from the root end through a predetermined length in the radial direction; and the radial length l, of said pressure-feed surface is 20 to 80% of the radial length $l_2$ of the close fin.

10. A fuel pump as in claim 7, wherein said fins on one side of said two sides of said impeller are offset with respect to said fins on the other of said two sides of said impeller.

11. A vehicle fuel pump comprising:

a casing;

an impeller having a top surface and a bottom surface, on both of which close fins ar formed continuously in a circumferential direction, close fins on the bottom surface being separated from close fins on the top surface; and driving means for driving and rotating said impeller such that fuel in a pump chamber formed between surfaces of each adjacent pair of close fins of said impeller is pressurized and pumped by the rotation of said impeller;

wherein pressure-feed surfaces parallel to a plane perpendicular to the direction of rotation of said impeller are respectively formed int eh side surfaces of each pair of close fins defining the pump chamber so as to extend from the root end through a predetermined length in the radiation direction; and wherein outer end portions of each pair of close fins defining the pump chamber are formed so as to be slanted relative to a plane perpendicular to the direction of rotation of said impeller and to be symmetric with each other so that the capacity of the pump chamber is increased.

12. A vehicle fuel pump according to claim 11, wherein a radial length $l_1$ of said pressure-feed surfaces is 20 to 80% of a radial length $l_2$ of the close fin.

13. A vehicle fuel pump according to claim 11, wherein an angle of inclination of the outer end portion of the side surface of the close fins is 5° to 37°.

14. A fuel pump as in claim 11, wherein aid close fins on the bottom surface are offset with respect to said close fins on the top surface.

15. A vehicle fuel pump comprising:

a casing;

an impeller on which close fins are formed continuously in the circumferential direction; and driving means for driving and rotating said impeller, a fuel in a pump chamber formed between surfaces of each adjacent pair of close fins of said impeller being pressurized and pumped by rotation of said impeller;

wherein a pressure-feed surface parallel to a plane perpendicular to the direction of rotation of said impeller is formed on an upstream side of said close fin with respect to the rotation direction of said impeller, in a way that a radial length $l_1$ of said pressure-feed surface is 20 to 80% of a full radial length $l_2$ of said close fin;

wherein a slanted portion is formed at a tip end of said pressure-feed surface in a way that an angle between said slanted portion and said plane perpendicular to the direction of the rotation of said impeller is between 5° and 37°; and wherein a slanted portion is formed on an outer end portion of a downstream side of said close fin so as to be symmetrically formed with said slanted portion located on the upstream side of said close fin.

16. A fuel pump as in claim 15, wherein said impeller has a top surface and a bottom surface, said close fins being separately formed on said top surface and said bottom surface and formed offset with respect to one another.

* * * * *